United States Patent [19]

Hasegawa et al.

[11] Patent Number: 4,466,411

[45] Date of Patent: Aug. 21, 1984

[54] AIR/FUEL RATIO FEEDBACK CONTROL METHOD FOR INTERNAL COMBUSTION ENGINES

[75] Inventors: Shumpei Hasegawa, Niiza; Toyohei Nakajima, Shiki, both of Japan

[73] Assignee: Honda Giken Kogyo Kabushiki Kaisha, Tokyo, Japan

[21] Appl. No.: 502,081

[22] Filed: Jun. 8, 1983

[30] Foreign Application Priority Data

Jun. 9, 1982 [JP] Japan ..... 57-98944

[51] Int. Cl.[3] ..... F02M 51/00

[52] U.S. Cl. ..... 123/480; 123/493; 123/492; 123/478; 123/489; 74/861

[58] Field of Search ..... 123/480, 492, 493, 478, 123/489, 440; 74/861; 364/431.05, 431.07

[56] References Cited

U.S. PATENT DOCUMENTS

| | | | |
|---|---|---|---|
| 4,389,996 | 6/1983 | Yaegashi et al. | 123/478 |
| 4,391,253 | 7/1983 | Ito | 123/480 |
| 4,392,471 | 7/1983 | Miyagi et al. | 123/480 |
| 4,401,087 | 8/1983 | Ikeura | 123/492 |
| 4,424,568 | 1/1984 | Nishimura et al. | 123/493 |
| 4,430,976 | 2/1984 | Kondo et al. | 123/480 |

FOREIGN PATENT DOCUMENTS

| | | | |
|---|---|---|---|
| 0210137 | 12/1982 | Japan | 123/489 |

*Primary Examiner*—Parshotam S. Lall
*Attorney, Agent, or Firm*—Lyon & Lyon

[57] ABSTRACT

An air/fuel ratio feedback control method which is adapted to control the air/fuel ratio of an air/fuel mixture being supplied to an internal combustion engine in response to the output of a means for detecting the concentration of an ingredient in the exhaust gases emitted from the engine. When the engine is operating in a predetermined feedback control region, control of the air/fuel ratio of the air/fuel mixture is carried out by the use of a first coefficient which has a value variable in response to the output of the aforementioned ingredient concentration detecting means, and simultaneously, the value of a second coefficient, which is a mean value of values of the first coefficient, is determined. When there occurs a transition in the operating condition of the engine from the feedback control region to one of a plurality of particular operating regions, the value of the first coefficient is held at a value of the same coefficient, obtained immediately before the above transition, and the held value is applied for the air/fuel ratio control until a predetermined period of time elapses, after the transition. After the above predetermined period of time elapses, the air/fuel ratio is controlled by the use of the aforementioned second coefficient in place of the above first coefficient. When the operation of the engine is returned to the feedback control region before the aforementioned predetermined period of time elapses, the above held value of the first coefficient is initially used as an initial value to control the air/fuel ratio. Preferably, the above predetermined period of time is set to a period of time required for completing a speed changing operation of the transmission gear of the engine. The aforementioned particular operating regions include a mixture-leaning region, a decelerating region and a fuel-cut effecting region.

10 Claims, 9 Drawing Figures

AIR/FUEL RATIO FEEDBACK CONTROL METHOD FOR INTERNAL COMBUSTION ENGINES

BACKGROUND OF THE INVENTION

This invention relates to an air/fuel ratio control method for feedback control of the air/fuel ratio of an air/fuel mixture being supplied to an internal combustion engine in response to concentration of an ingredient in the exhaust gases emitted from the engine, and more particularly to a method of this kind which enables positive control of the air/fuel ratio of the air/fuel mixture to values best suited for actual operating conditions of the engine or values close thereto, when the engine is operating in particular operating regions, to thereby improve the operational stability of the engine, as well as to eliminate a lag in the feedback control of the air/fuel ratio of the air/fuel mixture to a required value, which occurs when the operating condition of the engine is temporarily changed to a particular operating region from the feedback control region and returned to the latter, caused by the speed changing operation of the transmission gear.

A fuel supply control system adapted for use with an internal combustion engine, particularly a gasoline engine has been proposed e.g. by U.S. Pat. No. 3,483,851, which is adapted to determine the valve opening period of a fuel injection device for control of the fuel injection quantity, i.e. the air/fuel ratio of an air/fuel mixture being supplied to the engine, by first determining a basic value of the valve opening period as a function of engine rpm and intake pipe absolute pressure and then adding to and/or multiplying same by constants and/or coefficients being functions of engine rpm, intake pipe absolute pressure, engine cooling water temperature, throttle valve opening, exhaust gas ingredient concentration (oxygen concentration), etc., by electronic computing means.

Also, in an engine having a three-way catalyst arranged in its exhaust system, it is generally employed to control the air/fuel ratio of the mixture to a theoretical mixture ratio in a feedback manner responsive to the output of an exhaust gas concentration sensor which may be represented by an $O_2$ sensor, arranged in the exhaust system of the engine, to obtain the best conversion efficiency of unburned hydrocarbons, carbon monoxide and nitrous oxides in the exhaust gases emitted from the engine. However, this feedback control based upon the output of the exhaust gas sensor cannot be applied when the engine is operating in a particular operating condition such as engine idle, wide-open-throttle, mixture-leaning, and deceleration where the air/fuel ratio of the mixture needs to be controlled to a value different from the theoretical mixture ratio.

Therefore, in the case of applying the above exhaust gas concentration-based feedback to the aforementioned fuel supply control system using coefficients, etc., it is necessary to carry out open-loop control when the engine is operating in a plurality of particular operating conditions, by using coefficients having predetermined values corresponding to the respective particular operating conditions, so as to achieve desired predetermined air/fuel ratios best suited for engine operation under the above respective particular operating conditions.

It is thus desirable that the predetermined air/fuel ratio corresponding to the particular operating condition can be achieved with certainty by means of open-loop control. However, as a matter of fact, the actual air/fuel ratio can sometimes have a value different from the desired predetermined value due to variations in the performance of various sensors for detecting the operating condition of the engine and a system for controlling or driving the fuel quantity metering or adjusting means. In such event, it is impossible to obtain required operational stability and driveability of the engine.

To overcome such disadvantage, an air/fuel ratio feedback control system has previously been proposed by the applicants of the present application in Japanese Patent Provisional Publication (Kokai) No. 57-210137, in which the air/fuel ratio of an air/fuel mixture being supplied to the engine is controlled to required values or values close thereto by the use of a first coefficient which has a value variable in response to the output of an ingredient concentration detecting means that detects the concentration of an ingredient in the exhaust gases emitted from the engine, while the engine is operating in a feedback control region, and by the use of a second coefficient which is a mean value of values of the first coefficient applied during operation of the engine in the feedback control region, while the engine is operating in a particular operating region other than the feedback control region, to thereby improve the operational stability, driveability, emission characteristics, etc. of the engine.

However, according to this proposed system, when the engine is operating in the feedback control region, there can occur a temporary transition of the operation of the engine to a particular operating region upon operating the transmission gear and then returned to the feedback control region upon completion of the operation of the transmission gear. On such occasion, if the aforementioned second coefficient is used for controlling the air/fuel ratio of the air/fuel mixture simultaneously upon the above transition of the operation of the engine to the particular operating condition, the air/fuel ratio feedback control is resumed with the value of the same second coefficient applied as an initial coefficient value immediately when the operation of the engine is returned to the feedback control region. Consequently, there occurs a lag between the resumption of the feedback control and the time a required air/fuel ratio is actually obtained by the same feedback control, which is appropriate for the operating condition of the engine in the feedback control region, resulting in deterioration of the emission characteristics and wasteful fuel consumption of the engine.

SUMMARY OF THE INVENTION

It is an object of the invention to provide an air/fuel ratio feedback control method for internal combustion engines, which enables positive control of the air/fuel ratio of an air/fuel mixture being supplied to the engine to values best suited to the actual operating conditions of the engine or to values close thereto, while the engine is operating in each of a plurality of particular operating regions, to thereby improve the operational stability, driveability of the engine, etc. as well as to eliminate a lag in the feedback control of the air/fuel ratio to a required value, which occurs when the operation of the engine is returned to the feedback control region, after a temporary transition to a particular operating region, caused by operating the transmission gear, thereby improving the emission characteristics and fuel consumption of the engine.

According to this invention, a control method is provided for controlling the air/fuel ratio of an air/fuel mixture being supplied to the engine to required values in response to the output of an ingredient concentration detecting means that detects the concentration of an ingredient in the exhaust gases emitted from the engine, which comprises the following steps: (1) determining whether or not the engine is operating in a predetermined feedback control region or in any one of a plurality of predetermined particular operating regions other than the above feedback control region; (2) controlling the air/fuel ratio of the air/fuel mixture by the use of a first coefficient which has a value variable in response to the output of the aforementioned ingredient concentration detecting means, and at the same time, determining a mean value of values of the first coefficient as a second coefficient, while the engine is operating in the above predetermined feedback control region; (3) monitoring a period of time elapsing from a time it is determined that a transition occurs in the operating condition of the engine to one of the predetermined particular operating regions from the predetermined feedback control region, while the engine is operating in the above one particular operating region; (4) holding the value of the first coefficient at a value of the same coefficient obtained immediately before the above transition, and controlling the air/fuel ratio of the air/fuel mixture by the use of the above held value of the first coefficient, until the period of time monitored at the above step (3) exceeds a predetermined period of time; and (5) controlling the air/fuel ratio of the air/fuel mixture by the use of the aforementioned second coefficient in place of the first coefficient after the period of time monitored at the above step (3) has exceeded the predetermined period of time.

Preferably, the predetermined period of time of the step (4) is set to a period of time required for completing a speed changing operation of the transmission gear. Preferably, the aforementioned particular operating regions include a mixture-leaning region, a decelerating region, and a fuel-cut effecting region.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
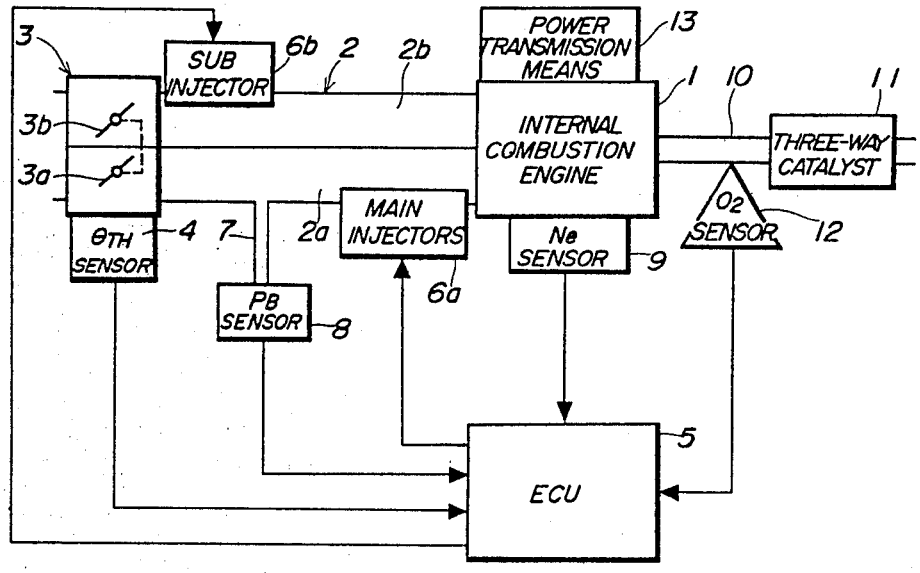
FIG. 1 is a block diagram illustrating the whole arrangement of a fuel supply control system to which is applicable the method according to the present invention.

FIG. 1 illustrates the whole arrangement of an air/fuel ratio feedback control system for internal combustion engines, to which the present invention is applicable. Reference numeral 1 designates an internal combustion engine which may be a four cylinder type, for instance. This engine 1 has main combustion chambers, not shown, which may be four in number and sub combustion chambers, not shown, communicating with the respective main combustion chambers. An intake pipe 2 is connected to the engine 1, which comprises a main intake pipe *2a* communicating with each main combustion chamber, and a sub intake pipe *2b* with each sub combustion chamber, respectively. Arranged across the intake pipe 2 is a throttle body 3 which accommodates a main throttle valve *3a* and a sub throttle valve *3b* mounted in the main intake pipe *2a* and the sub intake pipe *2b*, respectively, for synchronous operation. A throttle opening sensor 4 is connected to the main throttle valve *3a* for detecting its valve opening $\theta$th and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors *6a* and a sub injector *6b*. The main injectors correspond in number to the engine cylinders and are each arranged in the main intake pipe *2a* at a location slightly upstream of an intake valve, not shown, of a corresponding engine cylinder, while the sub injector *6b*, which is single in number, is arranged in the sub intake pipe *2b* at a location slightly downstream of the sub throttle valve *3b*, for supplying fuel to all the engine cylinders. The main injectors *6a* and the sub injector *6b* are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe *2a* at a location immediately downstream of the throttle valve *3a* of the throttle body 3. The absolute pressure sensor 8 is adapted to detect absolute pressure in the intake pipe 2 and supplies an electrical signal indicative of detected absolute pressure to the ECU 5.

An engine rpm sensor (hereinafter called "Ne sensor") 9 is arranged on a camshaft, not shown, of the engine 1 or a crankshaft of same, not shown. The Ne sensor 9 is adapted to generate one pulse at a particular crank angle each time the engine crankshaft rotates through 180 degrees, i.e., upon generation of each pulse of the top-dead-center position (TDC) signal. The above pulses generated by the sensor 9 are supplied to the ECU 5.

A three-way catalyst 11 is arranged in an exhaust pipe 10 extending from the main body of the engine 1 for purifying ingredients HC, CO, and NOx contained in the exhaust gases. An $O_2$ sensor 12 is inserted in the exhaust pipe 10 at a location upstream of the three-way catalyst 11 for detecting the concentration of oxygen in the exhaust gases and supplying an electrical signal indicative of a detected concentration value to the ECU 5.

An engine temperature sensor, not shown, for detecting the engine temperature (e.g. engine cooling water temperature) is mounted on the main body of the engine and an intake air temperature sensor, not shown, for detecting the intake air temperature, is arranged in the main intake pipe 2*a*. The former supplies an electrical signal indicative of detected engine temperature to the ECU 5, while the latter an electrical signal indicative of detected intake air temperature to the ECU 5.

Further connected to the ECU 5 are a sensor for detecting atmospheric pressure, a starter switch for actuating the starter of the engine 1, and a battery, none of which is shown, for supplying an electrical signal indicative of detected atmospheric pressure, an electrical signal indicative of its own on and off positions of the starter switch, and a supply voltage from the battery, respectively, to the ECU 5.

Reference numeral 13 designates a power transmission means that transmits the torque of the engine to wheels of the vehicle, not shown, e.g. a transmission gear, the operation of which selects a transmission gear or reduction ratio appropriate to the actual operating condition of the engine.

The ECU 5 operates on the various above engine operation parameter signals inputted thereto to determine the valve opening periods TOUTM and TOUTS for the main injectors 6*a* and the sub injector 6*b*, by the use of the following equations:

$$TOUTM = TiM \times K_1 + K_2 \quad (1)$$

$$TOUTS = TiS \times K'_1 + K'_2 \quad (2)$$

where TiM and TiS represent the basic fuel injection periods of the main injectors 6*a* and the sub injector 6*b*, each of which is read from a corresponding storage means within the ECU 5, as a function of the intake pipe absolute pressure PB and the engine rpm Ne, and $K_1$, $K'_1$ and $K_2$, $K'_2$ represent correction coefficients. These correction coefficients $K_1$, $K'_1$ and $K_2$, $K'_2$ are calculated on the basis of engine operation parameter signals from the various sensors, that is, the throttle valve opening sensor 4, the intake pipe absolute pressure sensor 8, the Ne sensor 9, the $O_2$ sensor 12, the engine temperature sensor, the intake air temperature sensor, and the atmospheric pressure sensor, by the use of respective predetermined equations so as to optimize the startability, emission characteristics, fuel consumption, accelerability, etc. of the engine in accordance with the operating conditions of the engine.

The coefficient $K_1$ is obtained as a product of the values of the air/fuel ratio correction coefficient $KO_2$, the mixture-leaning coefficient KLS, the intake air temperature-dependent correction coefficient KTA, the engine cooling water temperature-dependent coefficient KTW, the after-fuel cut fuel increasing coefficient KAFC, the atmospheric pressure-dependent correction coefficient KPA, and the mixture-enriching coefficient KWOT, by the following equation:

$$K_1 = KO_2 \times KLS \times KTA \times KTW \times KAFC \times KPA \times KAST \times KWOT \quad (3)$$

where the air/fuel ratio correction coefficient $KO_2$ is determined as a function of actual oxygen concentration in the exhast gases emitted from the engine, and the mixture-leaning coefficient KLS is selectively set to a constant value adapted to the actual operating condition of the engine. For example, the coefficient KLS is set to a predetermined value of 1 when the engine is operating in normal operating condition, while the same is set to a predetermined value of 0.8 when the engine is operating in a mixture-leaning operating condition.

The ECU 5 operates on the values of the fuel injection periods TOUTM, TOUTS calculated using the aforementioned equations (1) and (2) to supply driving signals to the main injectors 6*a* and the sub injector 6*b* to open same with duty factors corresponding to the calculated fuel injection periods.

Figure 2:
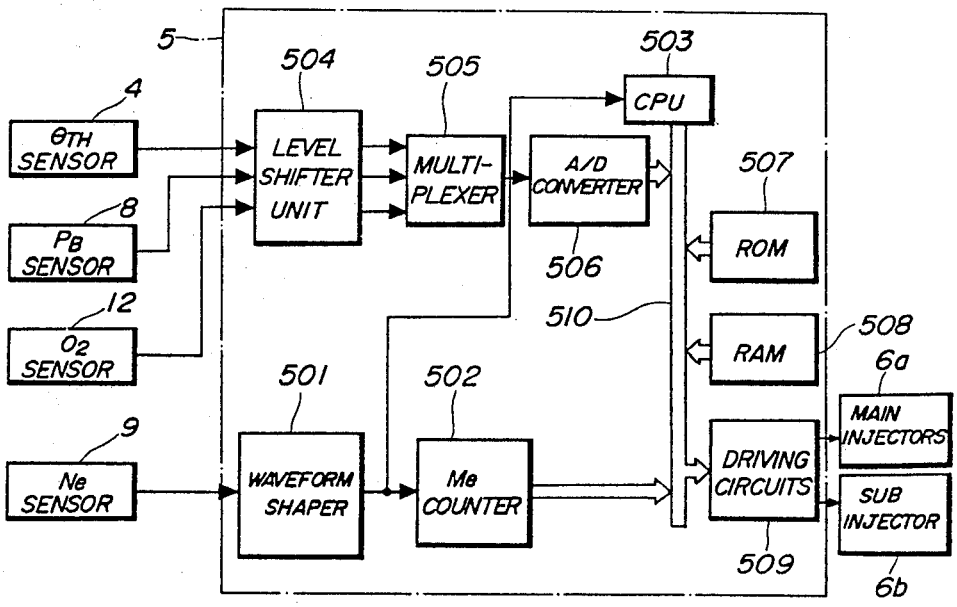
FIG. 2 is a circuit diagram showing an electrical circuit within the electronic control unit (ECU) 5 in FIG. 1.

FIG. 2 is a block diagram showing an electrical circuit within the ECU 5 in FIG. 1. The engine rpm signal from the Ne sensor 9 in FIG. 1 is applied to a waveform shaper 501, wherein it has its pulse waveform shaped, and supplied to an Me value counter 502 as well as to a central processing unit (hereinafter called CPU) 503 as a TDC signal. The Me value counter 502 counts the interval of time between a preceding pulse of the engine rpm signal generated at a predetermined crank angle of the engine and a present pulse of the same signal generated at the predetermined crank angle, inputted thereto from the Ne sensor 9, and therefore its counted value Me corresponds to the reciprocal of the actual engine rpm Ne. The Me value counter 502 supplies the counted value Me to the CPU 503 via a data bus 510.

The respective output signals from the throttle valve opening sensor 4, the absolute pressure sensor 8, the $O_2$ sensor 12, all appearing in FIG. 1, and other engine operation parameter sensors, not shown, have their voltage levels shifted to a predetermined voltage level by a level shifter unit 504 and applied successively to an analog-to-digital converter (hereinafter called "A/D converter") 506 through a multiplexer 505. The A/D converter 506 successively converts the above signals into digital signals and supplies them to the CPU 503 via the data bus 510.

The CPU 503 is also connected to a read-only memory (hereinafter called "ROM")507, a random access memory (hereinafter called "RAM") 508, and driving circuits 509, through the data bus 510. The ROM 507 stores a control program executed within the CPU 503, maps of basic fuel injection periods for the main injectors 6*a* and the sub injector 6*b*, and the correction coefficients and constants, while the RAM 508 temporarily stores the resultant values of various calculations from the CPU 503. The CPU 503 executes the control program stored in the ROM 507 in synchronism with the TDC signal to calculate the valve opening periods TOUTM, TOUTS for the main injectors 6*a* and the sub injector 6*b* by applying to the equations (1) and (2), values of the aforementioned coefficients and constants corresponding to the various engine operation parameter signals referred to previously, read out from the ROM 507 and supplies the calculated TOUTM and TOUTS values to the driving circuits 509 via the data bus 510. The driving circuits 509 supply driving signals corresponding to the above TOUTM and TOUTS values to the main injectors 6a and the sub injector 6b to energize same.

Figure 3:
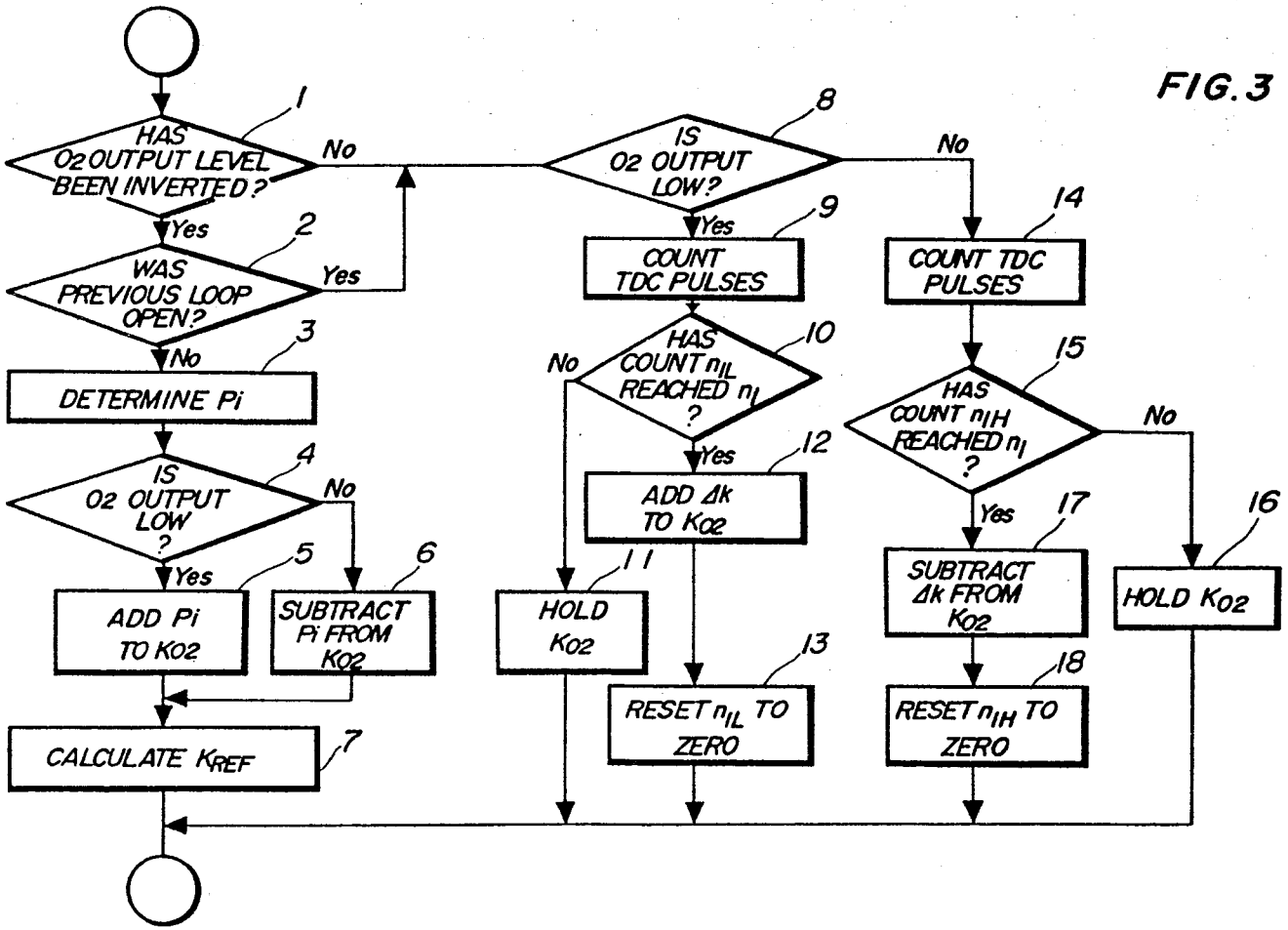
FIG. 3 is a flow chart showing a subroutine for calculating an air/fuel ratio correction coefficient $KO_2$.

FIG. 3 shows a flow chart of a subroutine for calculating the air/fuel ratio correction coefficient $KO_2$, which is executed in synchronism with generation of pulses of the TDC signal when the engine is operating in the feedback control region.

Figure 4:
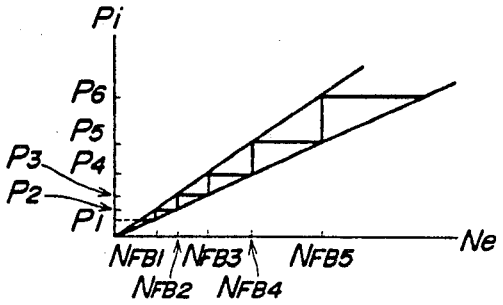
FIG. 4 is a view showing an Ne-Pi table for determining a correction value Pi for correcting the air/fuel ratio correction coefficient $KO_2$.

In FIG. 3, it is determined whether or not there has occurred an inversion in the output level of the $O_2$ sensor 12, at the step 1. If the answer is affirmative, whether or not the previous loop was an open loop is determined at the step 2. If it is determined that the previous loop was not an open loop, the air/fuel ratio of the mixture is controlled by proportional term control (P-term control). More specifically, referring to FIG. 4 showing an Ne-Pi table for determining a correction amount Pi by which the coefficient $KO_2$ is corrected, five different predetermined Ne values $NFB_{1-5}$ are provided which has values falling within a range from 1500 rpm to 3500 rpm, while six different predetermined Pi values $P_{1-6}$ are provided in relation to the above Ne values, by way of example. Thus, the value of correction amount Pi is determined from the engine rpm Ne at the step 3, which is added to or subtracted from the coefficient $KO_2$ upon each inversion of the output level of the $O_2$ sensor. Then, whether or not the output level of the $O_2$ sensor is low is determined at the step 4. If the answer is yes, the Pi value obtained from the table of FIG. 4 is added to the coefficient $KO_2$, at the step 5, while if the answer is no, the former is subtracted from the latter at the step 6. Then, a means value KREF corresponding to the present operation of the engine is calculated from values of $KO_2$ thus obtained, at the step 7. Calculation of the means value KREF can be made by the use of the following equation:

$$KREF = \frac{CREF}{A} \times KO_2p + \frac{A - CREF}{A} \times KREF \quad (4)$$

where $KO_2p$ represents a value of $KO_2$ obtained immediately before or immediately after a proportional term (P-term) control action, A a constant (e.g. 256), CREF a variable which is set within a range from 1 to A−1, and KREF' a mean value of values of $KO_2$ obtained from the start of the first operation of an associated control circuit to the last proportional term control action inclusive.

Since the value of the variable CREF determines the ratio of the value $KO_2p$ obtained at each P-term control action, to the value KREF, an optimum value KREF can be obtained by setting the value CREF to a suitable value within the range from 1 to A−1 depending upon specifications of an air/fuel ratio control system, an engine, etc. to which the invention is applied.

Figure 5:
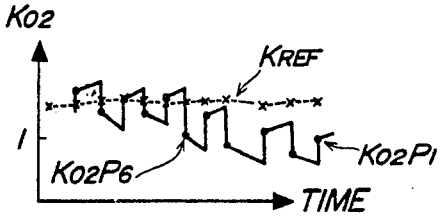
FIG. 5 is a graph showing a manner of determining the value of correction coefficient $KO_2$ by means of proportional term (P-term) control.

As noted above, the value KREF is calculated on the basis of a value $KO_2p$ obtained immediately before or immediately after each P-term control action. This is because an air/fuel ratio of the mixture being supplied to the engine occurring immediately before or immediately after a P-term control action, that is, at an instant of inversion of the output level of the $O_2$ sensor shows a value most close to the theoretical mixture ratio (14.7). Thus, a mean value of $KO_2$ values can be obtained which are each calculated at an instant when the actual air/fuel ratio of the mixture shows a value most close to the theoretical mixture ratio, thus making it possible to calculate a value KREF most appropriate to the actual operating condition of the engine. FIG. 5 is a graph showing a manner of detecting (calculating) the value of $KO_2p$ at an instant immediately after each P-term control action. In FIG. 5, the mark . indicates a value $KO_2p$ detected immediately after a P-term control action, and $KO_2p1$ is an up-to-date value detected at the present time, while $KO_2p6$ is a value detected immediately after a P-term control action which is a sixth action from the present time.

The mean value KREF can also be calculated from the following equation, in place of the aforementioned equation (4):

$$KREF = \frac{1}{B} \sum_{j=1}^{B} KO_2pj \quad (5)$$

where $KO_2pj$ represents a value of $KO_2p$ obtained immediately before or immediately after a jth P-term control action before the present one, and B a constant which is equal to a predetermined number of P-term control actions (a predetermined number of inversions of the $O_2$ sensor output) subjected to calculation of the mean value. The larger the value of B, the larger the ratio of each value $KO_2p$ to the value KREF. The value of B is set at a suitable value depending upon the specifications of an air/fuel ratio feedback control system, an engine, etc. to which the invention is applied. According to the equation (5), calculation is made of the sum of the values $KO_2pj$ from the P-term control action taking place B times before the present P-term control action to the present P-term control action, each time a value of $KO_2pj$ is obtained, and the mean value KREF of these values of $KO_2pj$ forming the sum is calculated. The mean value KREF calculated as described above is used for control of the air/fuel ratio of the mixture together with the other correction coefficients, that is, the wide-open-throttle correction coefficient KWOT and the mixture-leaning operation correction coefficient KLS, during an open loop control operation following a feedback control operation based upon the $O_2$ sensor output in which the same value KREF has been calculated. The open loop control operation is carried out in particular engine operating regions such as an engine idle region, a mixture-leaning region, a wide-open-throttle operating region, and a decelerating region.

Figure 6:
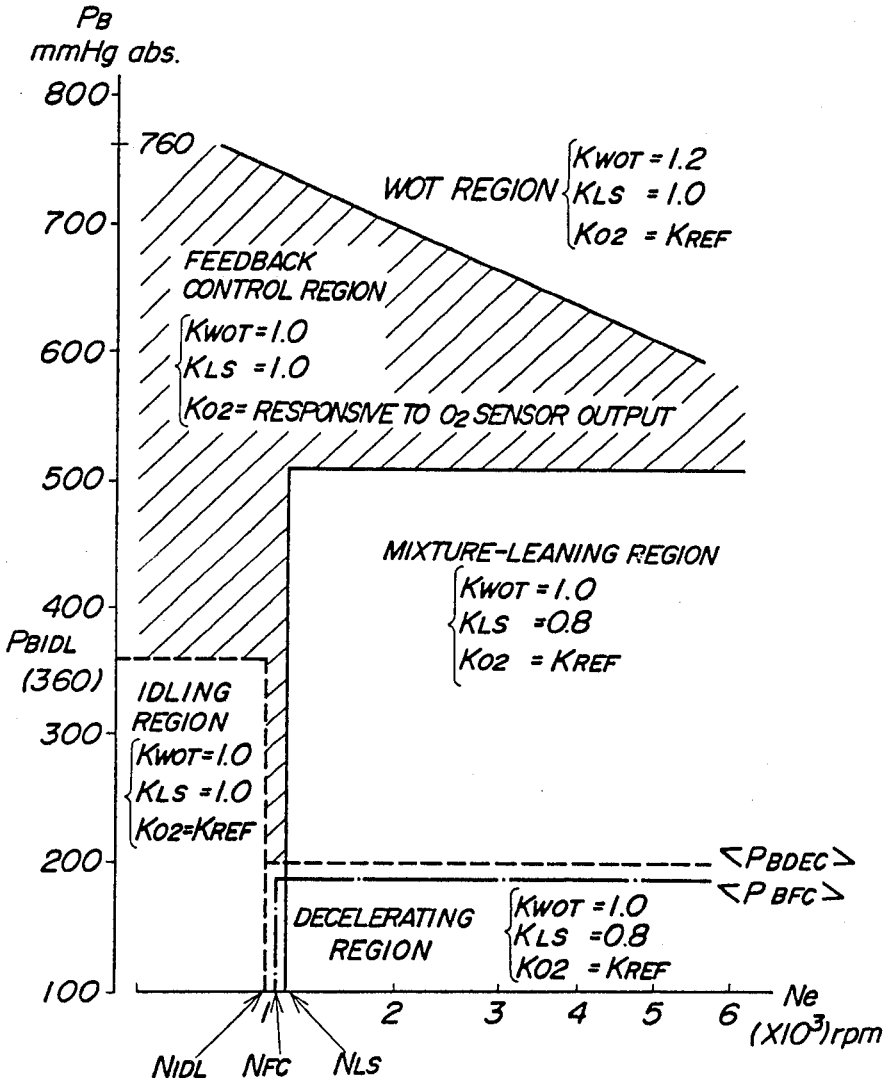
FIG. 6 is a graph showing a manner of applying correction coefficients to various operating regions of the engine.

More specifically, as shown in FIG. 6, in the wide-open-throttle operating region, the value of $KO_2$ is set to the mean value KREF obtained in the $O_2$ sensor output-based feedback control operation carried out immediately before the present time, and simultaneously the value of the wide-open-throttle coefficient KWOT is set to a predetermined value of 1.2, and the value of the mixture-leaning coefficient KLS a value of 1.0, respectively. In the mixture-leaning region and the decelerating region, the value of $KO_2$ is set to the above mean value KREF, the coefficient KLS a predetermined value of 0.8, and the coefficient KWOT a value of 1.0, respectively. In the idling region, the value of $KO_2$ is set to the above value KREF, and the coefficients KLS, KWOT are both set to 1.0.

In this way, the mean value KREF used during operation of the engine in particular operating regions, such as the mixture-leaning region and the decelerating region, is renewed each time a new value of $KO_2p$ is obtained based upon the $O_2$sensor output during each feedback control operation. Thus, the values of KREF obtained always fully represent the actual operating condition of the engine.

Further, the above mixture-leaning region and the decelerating region are, for example, defined as functions of predetermined values of the engine rpm Ne and the intake passage absolute pressure PB, as illustrated in FIG. 6. That is, the mixture-leaning region is set as a region wherein, the engine rpm Ne is larger than predetermined rpm NLS (e.g. 1200 rpm) while the intake passage absolute pressure PB is lower than a predetermined absolute pressure PBLS (e.g. 500 mmHg), and the decelerating region is set as a region wherein the engine rpm Ne is larger than predetermined rpm NIDL (e.g. 1000 rpm) while the intake passage absolute pressure PB is lower than a predetermined absolute pressure PBDEC (e.g. 200 mmHg), respectively. Also, when the engine rpm Ne is smaller than predetermined rpm NFCO (e.g. 2000 rpm), the fuel-cut effecting region is determined as a function of the engine rpm Ne and the throttle valve opening $\theta$th, that is, a region defined by engine rpm which is larger than predetermined rpm NFCT (e.g. 1000 rpm) while the throttle valve is in a substantially fully closed position, and when the engine rpm Ne is larger than the predetermined rpm NFCO, the fuel-cut effecting region is determined as a function of the engine rpm Ne and the intake passage absolute pressure PB. The latter region is provided to effect fuel cut so that the temperature of the three-way catalyst 11 does not rise above the maximum allowable bed temperature, and is defined as a region where the intake passage absolute pressure PB is lower than a predetermined value PBFC which is set to larger values with an increase in the engine rpm Ne. Details of the manner of determining the above fuel-cut region is disclosed in Japanese Patent Provisional Publication No. 57-191426.

Reverting now to FIG. 3, if the answer to the question of the step 1 is no, that is, if the $O_2$ sensor output level remains at the same level, or if the answer to the question of the step 2 is yes, that is, if the previous loop was an open loop, the air/fuel ratio of the mixture is controlled by integral term control (I-term control). More specifically, whether or not the $O_2$ sensor output level is low is determined at the step 8. If the answer is yes, TDC signal pulses are counted at the step 9, accompanied by determining whether or not the count nIL has reached a predetermined value nI (e.g. 30 pulses), at the step 10. If the predetermined value nI has not yet been reached, the $KO_2$ value is held at its immediately preceding value, at the step 11. If the value nIL is found to have reached the value nI, a predetermined value $\Delta k$ (e.g. about 0.3% of the $KO_2$ value) is added to the $KO_2$ value, at the step 12. At the same time, the number of pulses nIL so far counted is reset to zero at the step 13. After this, the predetermined value $\Delta k$ is added to the $KO_2$ value each time the value nIL reaches the value nI. On the other hand, if the answer to the question of the step 8 is found to be no, TDC signal pulses are counted at the step 14, accompanied by determining whether or not the count nIH has reached the predetermined value nI at the step 21. If the answer is no at the step 15, the $KO_2$ value is held at its immediately preceding value, at the step 16, while if the answer is yes, the predetermined value $\Delta k$ is subtracted from the $KO_2$ value, at the step 17, and simultaneously the number of pulses nIH so far counted is reset to zero at the step 18. Then, the predetermined value $\Delta k$ is subtracted from the $KO_2$ value each time the value nIH reaches the value nI, in the same manner as described above.

Figure 7:
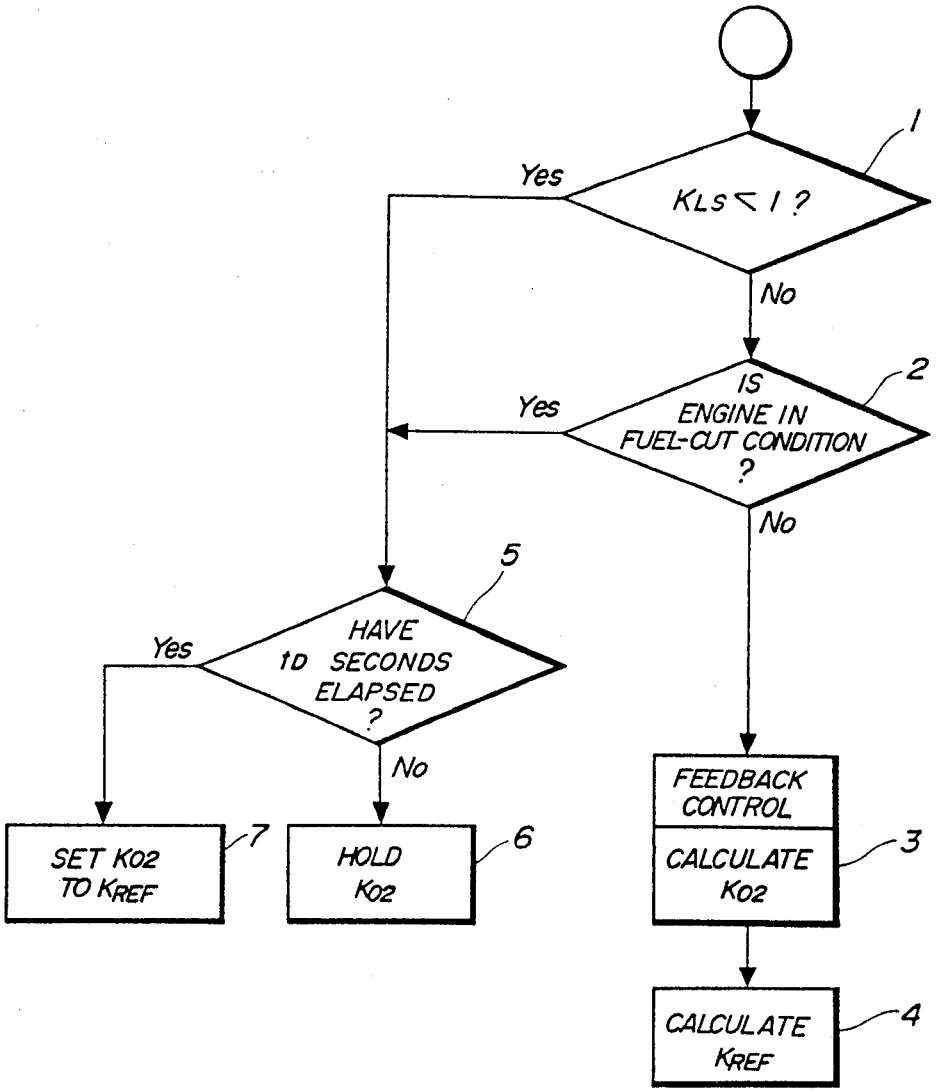
FIG. 7 is a flow chart showing a manner of applying the correction coefficient $KO_2$ when it is determined that the engine is operating in either one of the particular operating regions such as the mixture-leaning region, the decelerating region, and the fuel-cut effecting region, while the transmission gear is being operated.

Referring to FIG. 7, there is shown, by way of an example, a manner of applying the correction coefficient $KO_2$, which is based, for example, upon the assumption that it is determined that the engine is operating in either one of the mixture-leaning region, the decelerating region and the fuel-cut effecting region, while the transmission gear is being operated.

First, it is determined whether or not the engine is operating in either one of the mixture-leaning region, the decelerating region and the fuel-cut effecting region. The answer to the above question is determined, for example, in the following manner. The mixture-leaning correction coefficient KLS which is determined as a function of the engine rpm Ne and the intake passage absolute pressure PB is set to a value of 1.0 in the normal operating region and to a value of 0.8 in both the mixture-leaning region and the decelerating region, as explained before. Therefore, by determining whether or not the mixture-leaning coefficient KLS is smaller than 1.0, it is judged whether the engine is operating in the mixture-leaning region or in the decelerating region, at the step 1. At the step 2, a determination whether or not the engine is operating in the fuel-cut effecting region is made. For example, this determination is made by determining whether or not the engine is operating in a first predetermined operating region which is defined as a function of the engine rpm Ne and the throttle valve opening $\theta$th, which is applied when the engine rpm is smaller than predetermined rpm or in a second predetermined operating region which is defined as a function of the engine rpm Ne and the intake passage absolute pressure PB, which is applied when the engine rpm is larger than the above predetermined rpm. When the answers to both the questions at the step 1 and the step 2 are no, that is, when it is determined that the engine is operating in the feedback control region, the value of the correction coefficient $KO_2$ and the KREF value are determined by the use of the subroutine of FIG. 3, at the step 3 and the step 4, respectively. At this feedback control operation, changes in the value of the intake passage absolute pressure PB and the value of the correction coefficient $KO_2$ in relation to progress in time are expressed by the line I in FIG. 8 and the line II in FIG. 9, respectively.

Figure 8:
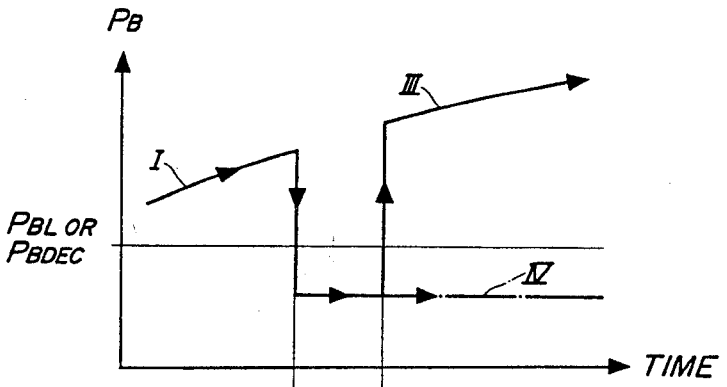
FIG. 8 is a timing chart showing changes in the value of the intake passage absolute pressure in relation to progress in time, while the transmission gear is being operated.

If the answer to the question at the above step 1 is yes, that is, if it is determined that the operation of the engine has entered either the mixture-leaning region or the decelerating region (at which stage, the intake passage absolute pressure PB becomes smaller than a predetermined value PBL or PBDEC in FIG. 8) or if the answer to the question at the above step 2 is yes, that is, if it is determined that the operation of the engine has entered the fuel-cut effecting region, it is further determined whether or not a predetermined period of time tD (e.g. 1 second) has elapsed since the determination that the operation of the engine had entered the respective above regions, in order to discriminate whether or not the transition in the operating condition of the engine to such regions was caused by a speed changing operation of the transmission gear, at the step 5. If the answer to the question at the step 5 is no, it is judged that the engine is operating in a first operating condition wherein the transmission gear is still being operated, and then the value of the coefficient $KO_2$ is held at a value $KO_2i$ obtained immediately before the determination that at the step 1 or at the step 2 gave an affirmative answer for the first time (step 6). The above value $KO_2i$ is then applied to the equations (1) and (3) to calculate the valve opening periods of the injectors. While the execution of this subroutine is repeated in synchronism with the output of the TDC signal pulses, if the answers to the questions at the steps 1 and 2 both become negative before the lapse of the aforementioned predetermined period of time tD, the feedback control is resumed, and the value of the coefficient $KO_2$ is calculated at the step 3. The $KO_2i$ value held at the step 6 as noted above is used as an initial value of the $KO_2$ value for the resumed feedback control operation (bent line III in FIG. 8 and bent line V in FIG. 9).

Figure 9:
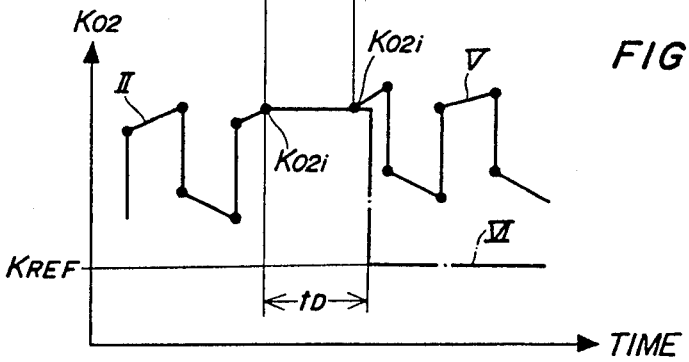
FIG. 9 is a timing chart showing changes in the value of the correction coefficient $KO_2$ in relation to progress in time, while the transmission gear is being operated.

If the answer to the question at the step 5 is in the affirmative, that is, if the above predetermined period of time monitored from a time the answer to the question at the step 1 or the step 2 was determined to be yes for the first time, has elapsed, it is judged that the engine is operating in a second operating condition, such as, the mixture-leaning region, and then the value of the coefficient $KO_2$ is set to its mean value KREF, at the step 7 and the valve opening periods of the injectors are calculated by applying the above mean value KREF to the equations (1) and (3) (bent line 1V in FIG. 8 and bent line V1 in FIG. 9).

What is claimed is:

1. A method for controlling the air/fuel ratio of an air/fuel mixture being supplied to an internal combustion engine for a vehicle, said engine having a power transmission means for transmitting the torque of the engine to wheels of the vehicle, to required values in response to the output of means for detecting the concentration of an ingredient in exhaust gases emitted from the engine, the method comprising the steps of: (1) determining whether the engine is operating in a predetermined feedback control region or in any one of a plurality of predetermined particular operating regions other than said feedback control region; (2) controlling the air/fuel ratio of the air/fuel mixture by the use of a first coefficient which has a value variable in response to the output of ingredient concentration detecting means, and at the same time, determining a mean value of values of said first coefficient as a second coefficient, while the engine is operating in said predetermined feedback control region; (3) monitoring a period of time elapsing from a time it is determined that a transition occurs in the operation of the engine from said predetermined feedback control region to one of said predetermined particular operating regions; (4) holding the value of said first coefficient at a value thereof obtained immediately before said transition, and controlling the air/fuel ratio of the air/fuel mixture by the use of said held value of said first coefficient, until said period of time monitored at said step (3) exceeds a predetermined period of time; and (5) controlling the air/fuel ratio of the air/fuel mixture by the use of said second coefficient in place of said first coefficient after said period of time monitored at said step (3) has exceeded said predetermined period of time.

2. A method as claimed in claim 1, wherein said power transmission means includes a transmission gear, and said predetermined period of time of said step (4) is set to a period of time required for completing a speed changing operation of said transmission gear.

3. A method as claimed in claim 1, wherein said predetermined particular operating regions include a mixture-leaning region wherein the air/fuel ratio of the air/fuel mixture is set to a value leaner than a theoretical air/fuel ratio.

4. A method as claimed in claim 1, wherein said predetermined particular operating regions include a decelerating region.

5. A method as claimed in claim 1, wherein said predetermined particular operating regions include a fuel-cut effecting region wherein the supply of fuel to the engine is interrupted.

6. A method as claimed in claim 1, including the step of applying said held value of said first coefficient as an initial value to control of the air/fuel ratio of the air/fuel mixture when the operating of the engine is returned to said predetermined feedback control region from said one predetermined particular operating region before said period of time monitored at said step (3) exceeds said predetermined period of time.

7. A method as claimed in claim 6, wherein said power transmission means includes a transmission gear, and said predetermined period of time of said step (4) is set to a period of time required for completing a speed changing operation of said transmission gear.

8. A method as claimed in claim 6, wherein said predetermined particular operating regions include a mixture-leaning region wherein the air/fuel ratio of the air/fuel mixture is set to a value leaner than a theoretical air/fuel ratio.

9. A method as claimed in claim 6, wherein said predetermined particular operating regions include a decelerating region.

10. A method as claimed in claim 6, wherein said predetermined particular operating regions include a fuel-cut effecting region wherein the supply of fuel to the engine is interrupted.

* * * * *